United States Patent [19]

Fukuchi et al.

[11] Patent Number: 4,994,853

[45] Date of Patent: Feb. 19, 1991

[54] APPARATUS FOR RECORDING COLOR IMAGES HAVING INTERCHANGEABLE PROCESS CARTRIDGES AND CARTRIDGE INFORMATION ON IC CARDS

[75] Inventors: Masakazu Fukuchi; Satoshi Haneda; Hisashi Shoji; Shunji Matsuo; Shizuo Morita, all of Hachioji, Japan

[73] Assignee: Konica Corporation, Tokyo, Japan

[21] Appl. No.: 439,282

[22] Filed: Nov. 20, 1989

[30] Foreign Application Priority Data

Nov. 25, 1988 [JP] Japan ..... 63-298867
Sep. 28, 1989 [JP] Japan ..... 1-256078

[51] Int. Cl.[5] ..... G03G 15/06

[52] U.S. Cl. ..... 355/208; 355/209; 355/246; 355/327

[58] Field of Search ..... 355/200, 201, 204, 208, 355/209, 210, 246, 260, 326, 327

[56] References Cited

U.S. PATENT DOCUMENTS 4,666,290 5/1987 Yoshiura ..... 355/209
4,699,501 10/1987 Watanabe et al. ..... 355/204 X
4,803,521 2/1989 Honda ..... 355/210 X
4,841,329 6/1989 Kasamura et al. ..... 355/326 X

FOREIGN PATENT DOCUMENTS 0252613 1/1988 European Pat. Off. ..... 355/218
58-72159 4/1983 Japan .
60-75850 4/1985 Japan .
0020563 1/1989 Japan ..... 355/210

*Primary Examiner*—Fred L. Braun
*Assistant Examiner*—J. E. Barlow, Jr.
*Attorney, Agent, or Firm*—Frishauf, Holtz, Goodman & Woodward

[57] ABSTRACT

A color image recording apparatus capable of detachably accommodating an interchangeable process cartridge incorporating plural kinds of developing devices. A plurality of kinds of interchangeable process cartridges are provided differing in the kind of developing devices incorporated therein, and each of such process cartridges has a predetermined operation mode corresponding to the kind of developing devices incorporated therein. Each of the plural kinds of process cartridges is adapted to be associated with a card-shaped memory storing data representing the predetermined operation mode. In the apparatus is provided an electric connection for forming an electrical circuit between the card-shaped memory associated with the accommodated process cartridge and the control device. The control device receives data from the card-shaped memory through the electric connection, and based thereon performs the predetermined operation mode of the accommodated process cartridge.

10 Claims, 7 Drawing Sheets

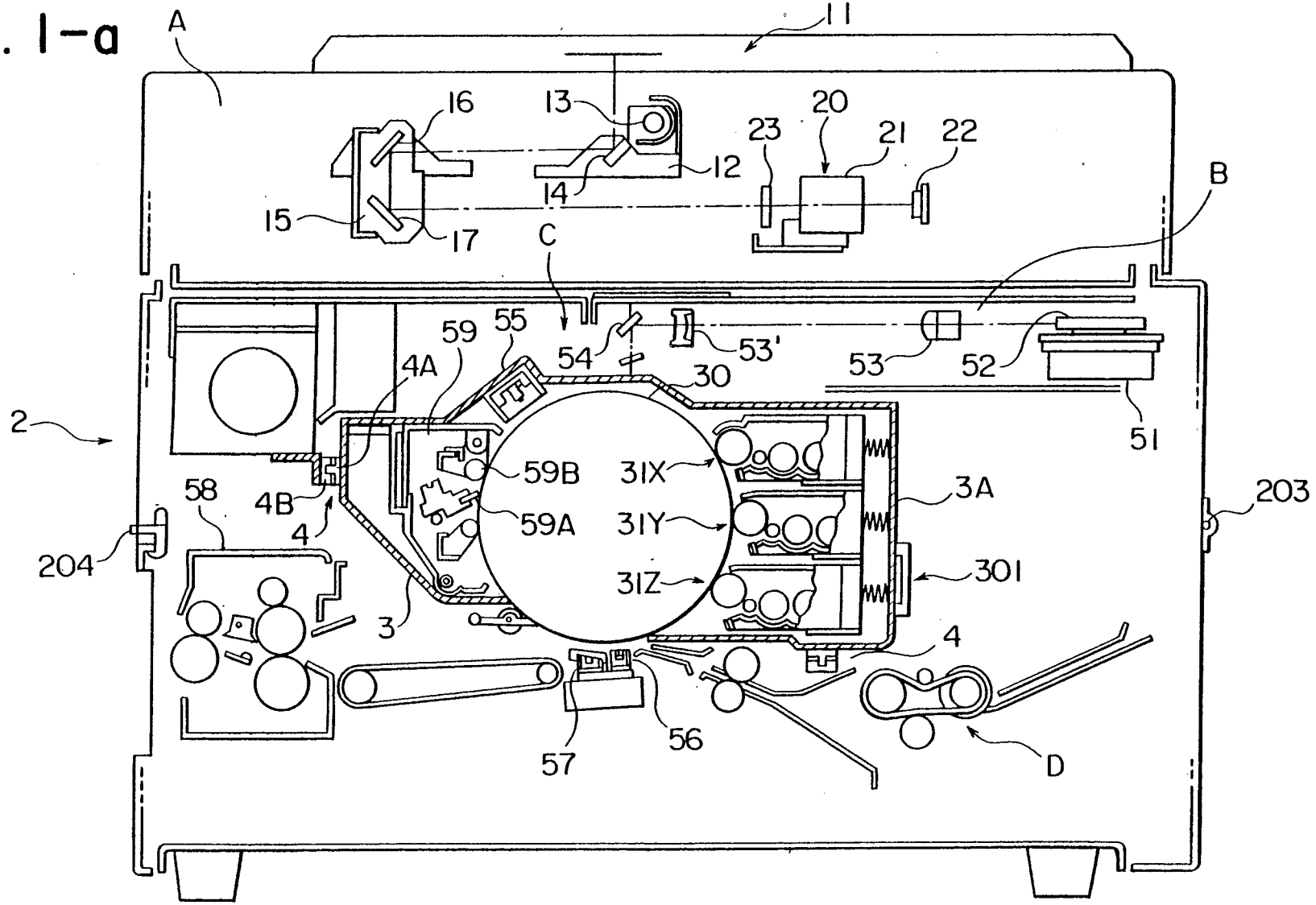
FIG. 1-a

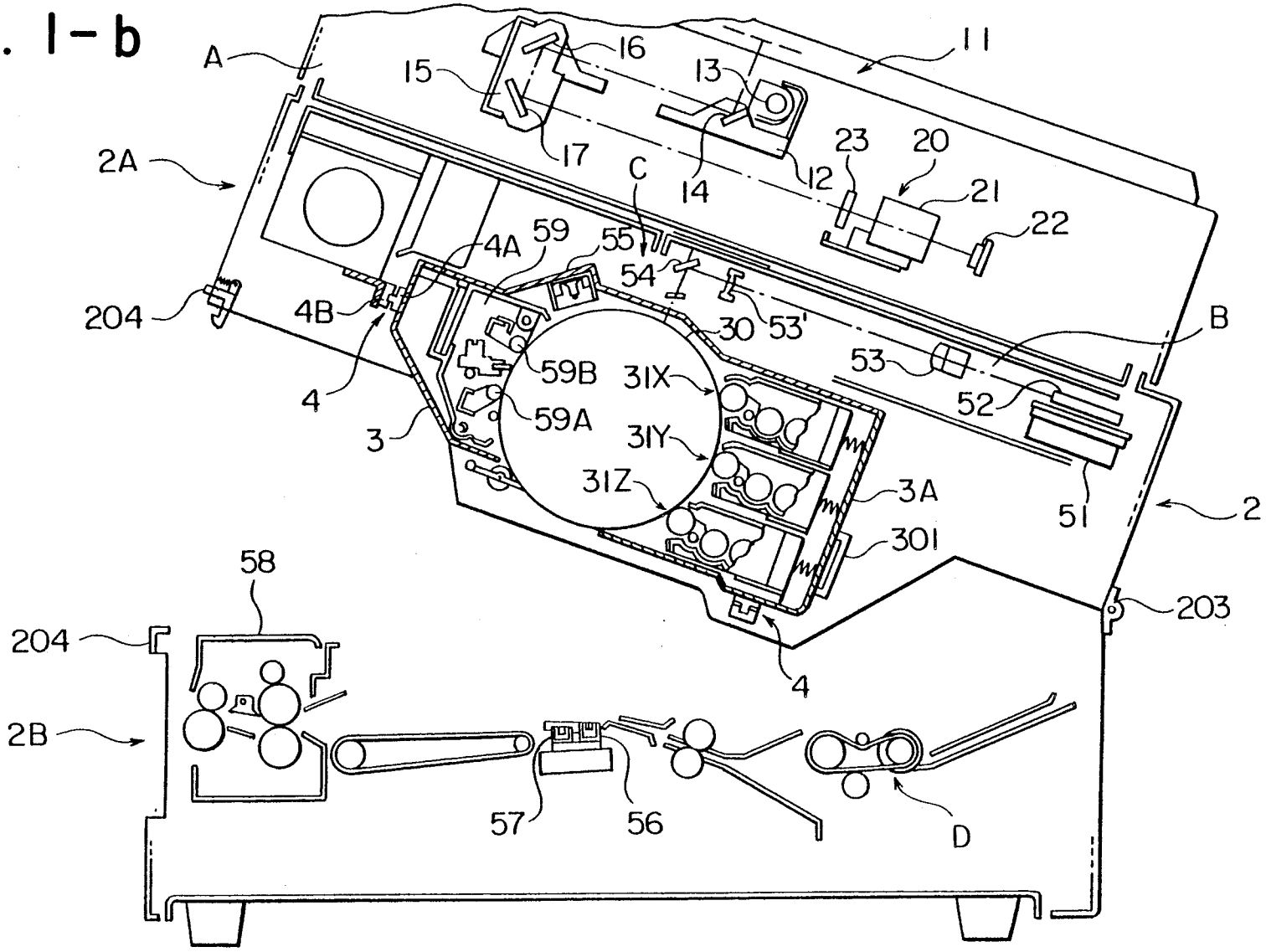
FIG. 1-b

APPARATUS FOR RECORDING COLOR IMAGES HAVING INTERCHANGEABLE PROCESS CARTRIDGES AND CARTRIDGE INFORMATION ON IC CARDS

BACKGROUND OF THE INVENTION

In an apparatus for recording electrophotographic images which forms a full-color image or a monochromatic image, there are installed around the photoreceptor drum, for example, a charging device for the photoreceptor drum, the an image exposing means for exposing an image on the photoreceptor drum, a developing device for developing the electro-static image on the photoreceptor drum with a toner, a transfer device for transfering the toner image on photoreceptor drum to the recording paper, etc.

Among the above, the developing device in the full-color image apparatus for recording electrophotographic image consists of three developing devices, respectively storing yellow (Y), Magenta (M) and Cyan (C) toner, and arrangements are so made that a full-color image can be obtained by forming each toner image of Yellow (Y), Magenta (M), Cyan (C) on the photoreceptor drum, while the photoreceptor drum makes 3 revolutions, and by transfering those toner images to the recording paper.

In such full-color image apparatus for recording electrophotographic images, perfect conditions of having a correct mixing ratio among each toner of Yellow (Y), Magenta (M), Cyan (C) cannot always be obtained. Therefore, in specially attempting to obtain a black image, there are cases where a clear black image cannot be obtained by having the black image reddish or bluish.

Therefore, in order to obtain clear black image, developing with Black (BK) toner is conducted, by providing a developing device storing Black (BK) toner, in addition to Yellow (Y), Magenta (M), Cyan (C) toners, and not by mixing 3 colors of Yellow (Y), Magenta (M), Cyan (C).

However, since a developing device storing Black (BK) toner, in addition to Yellow (Y), Magenta (M), Cyan (C) toners, has to be provided, there is a problematic point that the apparatus tends to be of large-size.

Therefore, there is stated in the Japanese Patent Publication Open to Public Inspection No. 72159/1983 an image forming apparatus of transfering drum type, where there is provided an exclusive black-and-white image unit, having a photoreceptor drum, a corona charging device which makes the photoreceptor drum surface charged uniformly, a developing device and a cleaning device as an integrated unit, wherein the unit is detachably mounted on the apparatus body and alternately interchanged with such unit, an exclusive color image unit, having the photoreceptor drum, a corona charging device, the developing device for color images, in which Yellow developing device, Magenta developing device and Cyan developing device are sequentially installed in the rotating direction of photoreceptor drum, and the cleaning device as an integrated unit of mountable construction. Further, in the patent publication, there is also stated that when either one of the above two units is mounted on the apparatus body, the control circuit for obtaining color copying or the control circuit for obtaining black-and-white copying can be selected automatically.

However, automatic selection of the image forming conditions as stated in the Japanese Patent Publication O.P.I. No. 72159/83 is determined according to the number of combination between the protrusion on the unit side and the microswitch on the body side or according to the resistance value by electrical connection between the pin on the unit side and the jack on the body side. Such detection means will require mechanical precision of each part and will pose problems of malfunction due to fault in such parts. Particularly, when there are a large number of unit types, it becomes difficult to determine by the resistance value. In the type which uses microswitches, there is a problem of requiring arrangement of a large number of microswitches.

The use of color copier and color printer is quite diversified, and user requirements are also diversified. In particular, the color of toners used, the combination of colors, and consumption of toner have become very varied, thereby making it difficult to provide an apparatus for recording color image to satisfy all of the requirements, as a general-purpose equipment.

In order to solve this problem, providing a recording apparatus body for common use has been made and recording of several colors has been made possible, to which various process cartridges, each having a developing unit which stores plural kinds of toners, are replaceably mounted. However, in this case, it is very cumbersome for an operator to have the information on various combinations of the color toner to be stored in the recording apparatus body in advance and to operate it according to the indication every time when the processing cartridge is replaced. This will also increase possibilities of faulty indication and faulty operation.

SUMMARY OF THE INVENTION

The object of the present invention is to provide an apparatus for recording color images, by preparing various process cartridges which are replaceable, where the recording apparatus does not require storage of information on various combinations, and where the switching of process mode can be made automatically with a simple mechanism of replacement.

The above object can be accomplished by an apparatus for recording color images, which is characterized by having the cartridge storage for storing the process cartridge capable of holding plural developing devices and the IC card insertion portion for inserting IC card corresponding to the above process cartridge, and also by having the indication controller to control the indication based on the stored information which is stored in the above IC card and the sequential controller to control the process sequence.

The above object can be accomplished by an apparatus for forming color images, which is characterized by having the construction which permits replacement between a first process cartridge which at least has a first developing unit, having plural color developing devices for color use, and a second process cartridge which at least has a second developing unit, having at least a developing device for black color use, which has black toner, and which is also characterized by identifying the above developing unit mounted on the apparatus body or the above process cartridge including the above developing unit, using the IC card, and by selecting automatically the mode depending on the combination of the developing device in the above developing units mounted on the apparatus body.

BRIEF DESCRIPTION OF THE DRAWINGS

FIG. 1 (*a*), (*b*) are construction drawings of an apparatus for recording color images of the present invention, and FIG. 1 (*a*) shows the operating condition and FIG. 1 (*b*) the opened condition.

DETAILED DESCRIPTION OF THE INVENTION

Figure 2:
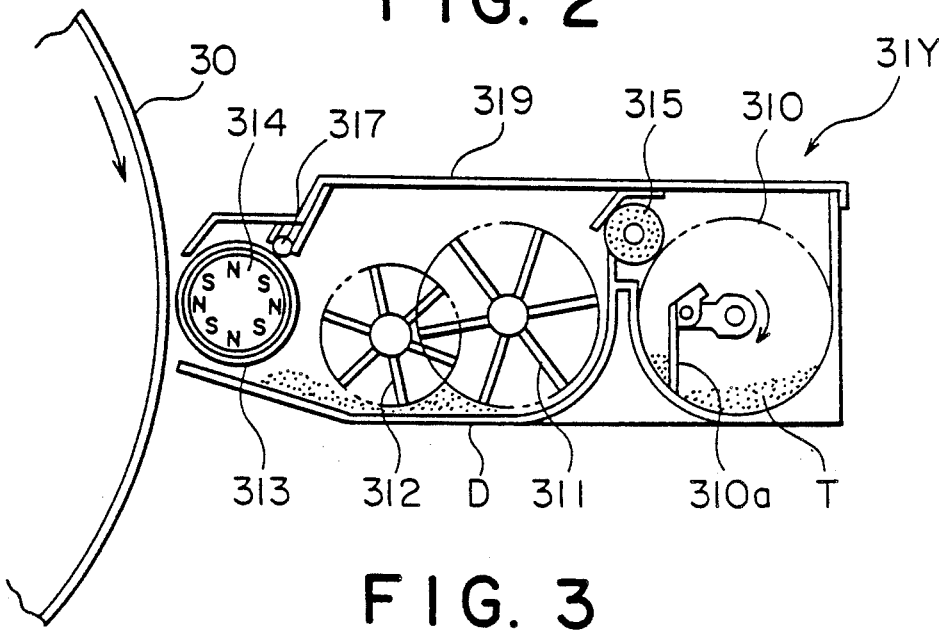
FIG. 2 is a sectional view of the developing device used in the above apparatus.

With respect to the process cartridge which can be detachably mounted on the apparatus for recording color images of the present invention, the following can be listed from its colors, for example:

Mono-color (BK) (Y) (M) (C) (Red) (Blue) (Green)

Two colors (BK and one color out of Red, Blue and Green) (Y and M) (M and C) (Y and C)

Three colors: (BK and two colors out of Red, Blue and Green) (Y, M and C)

Four colors : (BK, Y, M and C)

Before explaining the apparatus for recording color images of the present invention, an explanation will be made on the apparatus for recording color images, using multi-color image forming method under the toner layer developing method, disclosed in the Japanese Patent Publication 0.P.I. No. 75850/1985, etc., by the present assignee, to which the present invention is applicable, where process cartridges containing developer of 3 colors, namely Yellow (Y), Magenta (M), Cyan (C), are mounted.

FIG. 1 shows the principal construction of the apparatus for recording color images, where A is the image reading system, and B the laser writing system, constituting each unit. Further, C is the image forming part, and D the paper feeder. Color images are arranged to be formed by the following process.

In the above reading system A, 11 is a platen where the document is placed, and the document held on platen 11 is illuminated by the halogen lamp 13 attached to the carriage 12, which slides in horizontal direction. Attached to the movable mirror unit 15 are the mirrors 16 and 17, which lead out the light image of the document to the optical reading unit 20, in combination with the mirror 14, sliding horizontally in the same manner, being attached to the above carriage 12.

The above carriage 12 and the above movable mirror unit 15 are driven by a stepping motor via the wire connected to such motor and unit 15 (both are not shown in the drawing), and are slided in the same direction at a speed of V and $\frac{1}{2}$ V respectively.

In the optical reading unit 20, there are the lens 21 and the CCD22 at the image formation position behind such lens, and in front of lens 21 there is the filter 23 which moves under control of CPU, in the direction perpendicular to the paper surface. Filter 23 is used for color separation at the time of reading the document on the document platen 11, and there are filters for passing red light, green light and blue light and the neutral filter for passing all three colors. CPU issues a command to let the red filter deal with developing by use of Cyan (C) toner, the green filter in developing by use of Magenta (M) toner, and the blue filter in developing by use of Yellow (Y) toner, and the filter setting is made by the filter selection circuit. Further, in developing by use of Black (BK) toner, the neutral filter is made to deal therewith.

The color signal, which has been color-corrected according to the toner color, will be input into the above laser writing system B, which is the exposure means.

In the laser writing system B, the laser beam generated in the semiconductor laser (not shown in drawings) is scanned by the polygon mirror 52, which is rotated by the driving motor 51, and passes through f$\theta$ lens 53, cylindrical lens 53', and its light path is bent by the mirror 54, then scans on the peripheral surface of the image carrier 30, which had been electrically charged beforehand by the charging device 55, as the charging means.

On the other hand, when scanning is started, the beam is detected by index sensor, by which modulations of beam by the first color signal is started, and the modulated beam scans on the peripheral surface of the above image carrier 30. Accordingly, the latent image corresponding to the first color is formed on the peripheral surface of the image carrier 30 by the main scanning due to laser beam and by the such scanning due to rotation of the image carrier 30. This latent image is developed by the developing device 31X having the Yellow (Y) toner (developing agent), for example, among the several developing devices provided in parallel, and the toner image is formed on the drum surface, in the present embodiment. The toner image thus obtained will pass underneath the cleaning device 59, as the cleaning means, which is detached from peripheral surface of the image carrier 30, while the toner image is being held on the drum surface, and will enter into the copy cycle, which comes next.

That is, the above image carrier 30 is made electrically charged again by the above charging device 55, then the second color signal, being output from the signal processor, is input into the above writing system unit B, by which writing on the drum surface is made and latent image is formed in the same manner as in the case of the first color signal, as described above. This latent image is developed by the developing device 31Y, having Magenta (M) toner, for example.

This Magenta (M) toner image is formed under the presence of the above described Yellow (Y) toner image, which had already been formed.

31Z is a developing device having Cyan (C) toner, and forms Cyan (C) toner image on the drum surface based on the image signal generated in the signal processor. To the sleeve of each of these developing devices 31X, 31Y, 31Z, alternating current biased with direct current is applied, thereby arranging to conduct non-contacting development with 2 component type developer, which is the visual image forming means, and then latent image portion made on the image carrier 30 is developed by the noncontacting development.

In this manner, the color images formed on the peripheral surface of the image carrier 30 are transfered onto the recording paper, as the recording medium, which had been sent by the conveying means, such as paper feeding belt, roller, etc., from paper feeder D, at the transfering electrode 56, which had been provided as the transfering means. The recording paper on which the toner image is transfered is separated from the drum surface by the separating electrode 57, and is brought into the fixing device 58 via a conveying belt.

On the other hand, the residual toner remaining on the image carrier 30, from the drum surface of which the recording paper was separated, will be cleaned by bringing the blade 59A of the above cleaning device 59 into contact with the surface of the image carrier drum 30. Upon completion of such cleaning, the blade 59A is separated from the peripheral surface of the drum, and the image carrier 30 enters freshly into the next color image forming process.

Then, layout of each of the principal components will be explained. As shown in FIG. 1, the above image reading system A is stored in an independent, exclusive box, and is attached to the main body 2, which is to be described later, and system A being mounted on the top of main body 2.

In the above main body 2, there are incorporated the image recording system consisting of the above writing system B, the image forming part C, the paper feeder D, etc., and it is so arranged to receive color signals from the above image reading system A, via a group of flexible cables (not shown) connected to the box.

The above main body 2 is split vertically into two upper box 2A, and lower box 2B as shown in FIGS. 1*b* . In approximately the middle of the main body 2, there is placed the image carrier 30, and facing its right peripheral surface there are placed each of the above developing device 31X, 31Y, 31Z in horizontal condition, and facing its left peripheral surface, on the other hand, there are placed the above charging device 55 and the above cleaning device 59.

Any of the above image carrier 30, each of the developing devices 31X, 31Y, 31Z and the cleaning device 59 is not directly attached to a pair of front and rear base plates fixed to the main body 2, but is supported on its axis by or detachably attached to the process cartridge 3 which is detachably incorporated into the upper box 2A of the main body 2.

Figure 4:
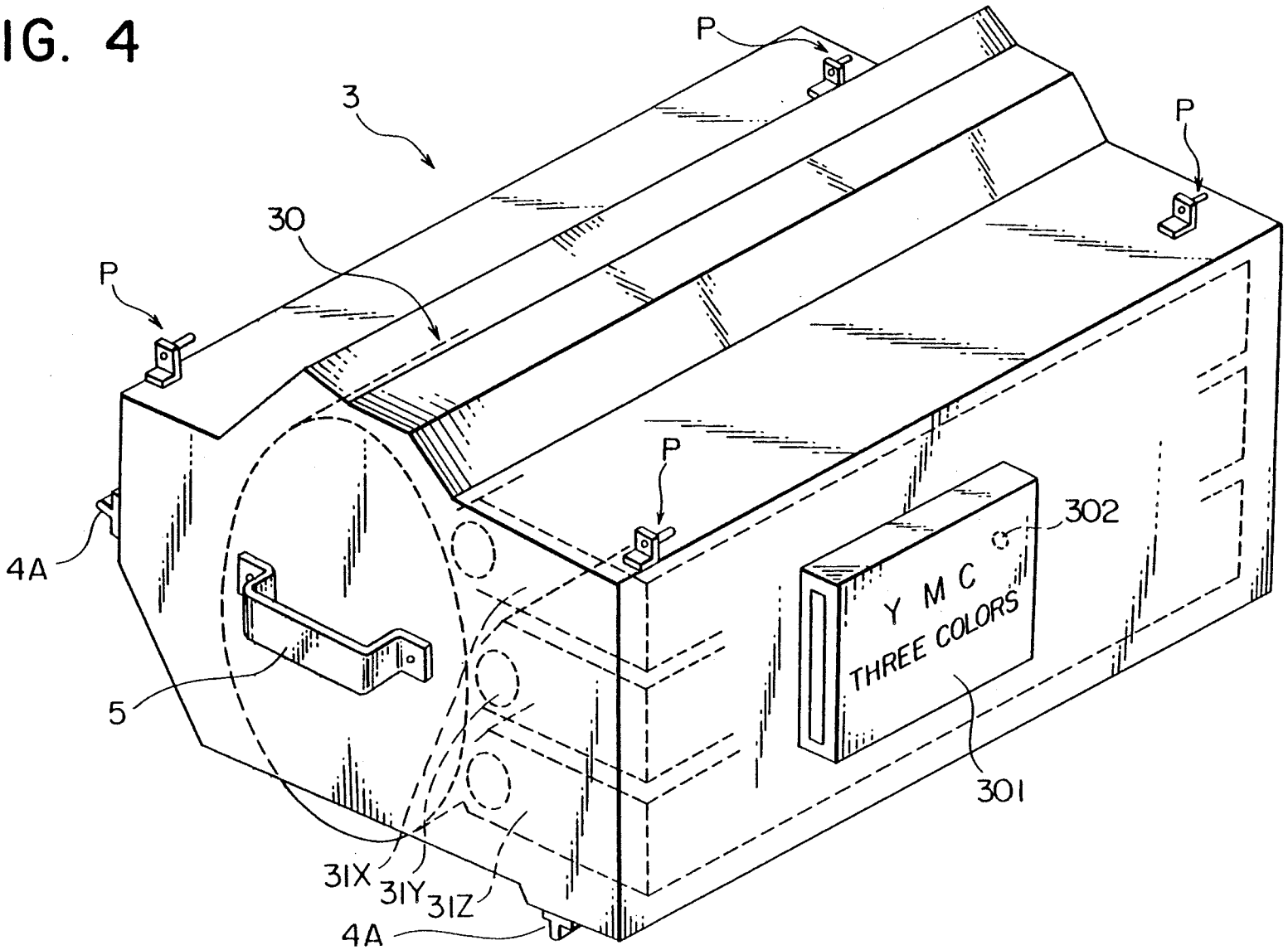
FIG. 4 is a perspective view of the process unit.

The above process cartridge 3 has an outer form shown in FIG. 4, and its frame construction consists of 3 sheets of similar panels, which are mutually fixed to make an integrated body by use of stays, etc. It can be easily taken out from or attached to the main body 2, by a pair of right and left guide members 4.

That is, at the left side and the right bottom side of the above process cartridge 3, there are the rails 4A fixed thereto, and on the other hand at the positions of the main body 2 corresponding to such rails 4A, there are the guide rails 4B fixed thereto, respectively as shown in FIG. 4 and FIG. 1(*a*). Rails 4A and guide rails 4B form slidable and detachable mechanical pairs by engaging each other.

Further, near the four corners on the upper surface of the above panel, there are attached a pair of registration pins P, respectively at left and right. Such pins can be inserted into holes of the suspenders Q (not shown in drawing), attached at the fore and aft base plates fixed to the main body 2, so as to register and hold the process cartridge correctly to the relative positions with the above image carrier 30, each of the developing devices 31X, 31Y, 31Z and the cleaning device 59 with respect to the main body 2.

Accordingly, the above process cartridge 3 can be drawn forward, when the grip 5 on the front surface of the panel is pulled, being drawn out of the above rails 4B, to the front of the main body 2. Further, by pushing the above grip 5 inward, the above registration pins P engage into the holes of the above suspenders Q and the above process cartridge 3 becomes suspended, thereby being housed in the main body 2.

By having such a construction, where the above process cartridge 3 is held in suspended condition with respect to the base plates of the upper box 2A of the main body 2, vibrations or shocks, transmitted from motor, etc. attached to the main body 2, to the above image carrier 30, each developing devices or cleaning device will be relieved or absorbed substantially, and even if transmitted to some degree, each device will receive vibrations or shocks equally. Therefore, since the plural developing devices and photoreceptor drum, for example, are held in uniform conditions mutually, there will be no serious hindrance in the image forming process.

By integrally holding the image carrier 30 and the cleaning device 59 with the process cartridge 3, this construction considerably relieves or absorbs ill effects from vibrations, shocks, etc., specially, caused on delicate pressure-fitting condition, press-contacting condition, overlaying condition, etc., at the time of contacting/separating of the blade 59 or pressure contacting of the second cleaning roller 59B, etc. for cleaning the residual toner on the photoreceptor drum, which has to be carried out on the cleaning device, when toner images are formed by overlaying developing.

In the case of an image forming process, such as the above described overlaying method, the above image carrier 30 will require a peripheral surface length equivalent to a length of one page of B4 size or A3 size, the largest size to be recorded, to which some margin is added. Its outer diameter dimension will require an approximate size of 130 mmϕ to 150 mmϕ at the least, and for transfer paper equivalent to A4 size a photoreceptor drum size of 80 to 110 mmϕ in diameter is required. In the present embodiment a photoreceptor drum of 110 mmϕ has been used.

On the other hand, with respect to each of the developing devices 31X, 31Y, 31Z, as explained in detail later, based on the result that thickness (height) of each developing device could be adequately reduced to around 30 mm or less by reducing the outer dimension of developing sleeve to 20 mmϕ, without lowering the image performance, it has become possible to place the plurality of developing devices, namely three or four developing devices, for with color copying, namely, the developing devices 31X, 31Y, 31Z in the present embodiment, within the space corresponding to the range of the outer diameter dimension of the above image carrier 30, further, being stacked in horizontal condition.

Therefore, the above cartridge 3 is adequately capable of mounting and accommodating the above cleaning device 59 as well as all of the plural developing devices 31X, 31Y, 31Z, even if its vertical height is limited to the minimum dimension adequate to cover the image carrier 30, so as not to affect the layout of the components which are directly attached and fixed to the main body 2, such as the laser writing system B at the top, the transfering electrode 56 and the separating electrode 57 at the bottom as well as each component in conveying system. Such arrangement permits to construct the conveying route of recording paper nearly a straight line, thereby being effective for prevention of jamming.

In the present embodiment, the upper box 2A, to which the cartridge 3 is attached, is of clamshell type, which can be opened. When the upper box 2A is opened, it is separated by the conveying route of recording papers, thereby permitting easy disposition of the jamming, if it has occurred.

That is to say, in the apparatus for forming color images, having functions as explained in the foregoing, the process cartridge 3 of the present embodiment is attached to the upper box 2A, and the upper box 2A can be opened or closed with respect to the lower box 2B, where the main body 2 is of a construction which can be split into two. FIG. 1 (*b*) shows a condition, where the upper box 2A is opened. In the apparatus for recording color images of the present invention, the lower box 2B and the upper box 2A have the hinge 203 installed, which serves as the center for opening and closing, in parallel to the axis of the photoreceptor drum 30, close to one end surface on the side where the developers 31X, 31Y, 31Z are positioned with respect to the photoreceptor drum 30. Further, on the other side, opposite to the hinge 203, there is provided opening/closing metal pieces 204, at both the upper box 2A and the lower box 2B. By unlocking the opening/closing metal pieces 204 and lifting the upper box 2A in clockwise direction in the drawing, it will be opened. Ranging from the lower box 2B to the upper box 2A there are provided balancing component and locking component, made of energized spring member, etc., which are not shown in drawing. They will permit easy opening of the upper box 2A in clockwise direction in the drawing, without requiring much force, and the opened condition will be held by the holding component, and the opened condition can be maintained even if the hands are released.

In the present embodiment, since the process cartridge 3, including the photoreceptor drum 30, and cleaning device 39 and developing unit 3A to the left and right thereof, is attached to the upper box 2A, the process cartridge moves upward when opened, and the developing sleeves 313 (see FIG. 2), corresponding to the openings of the developing devices 31X, 31Y, 31Z, which are positioned in parallel, will each take an upward posture, and the toner storage part 310 will be positioned on the lower side. In this condition, the process cartridge 3 can be taken out horizontally, namely perpendicularly to the drawing surface. At this time, since the openings of the developing device 31X, 31Y, 31Z, are in an upward posture, the developer will not spill out or mix into other developing devices due to shocks when detaching or attaching the process cartridge 3. Further, since the feeding means of transfer paper, the transfer electrode 56, the separating electrode 57, conveying means of conveying the transfer material, and the fixing device 58 are attached to the lower box, the conveying route of transfer material is exposed by upwardly opening the upper box 2A, thereby permitting easy disposition of the jamming by inserting hands directly, if faulty conveyance of transfer paper takes place.

For each of the above developing devices 31X, 31Y, 31Z, those of the following construction are used.

For each of the developing devices 31X, 31Y, 31Z in the present embodiment, the developing device of the same construction is used. Therefore, the developing device used in the present invention will be explained by a sectional view of the developing device 31Y shown in FIG. 2.

In FIG. 2, there are provided the toner storage device 310, stirring impeller 311, stirring impeller 312, developing sleeve 313, magnet roll 314 and toner feeding roller 315 inside the developing device 31Y. There is provided the cover 319 at the top of the developing device 31Y, which prevents dispersion of the toner by covering the toner storage device 310, stirring impeller 311, stirring impeller 312, developing sleeve 313, magnet roll 314 and toner feeding roller 315 therein. Further, the gap between the developing sleeve 313 and the photoreceptor drum 30 is maintained by a roller (not shown in drawing), which is provided coaxially with the developing sleeve 313 and is in contact with the photoreceptor drum 30.

In the bottom of the toner storage device 310, there is stored the toner T, and the toner T is scooped up in upper left direction in FIG. 2 by clockwise rotation of the dredging board 310*a*. The toner T scooped up by the dredging board 310*a* will be moved to the left direction in FIG. 2 by rotation of the toner feeding roller 315, and is supplied to stirring impeller 311. Stirring impeller 311, together with stirring impeller 312, will stir the magnetic carrier and the toner T. Stirring impeller 311 and stirring impeller 312 rotate in opposite directions, thereby increasing the conveying distance and also providing adequate stirring and mixing of magnetic carrier and toner. This two-component type developer D, made up of magnetic carrier and toner T, is supplied to the developing sleeve 313, after being stirred and mixed. There is placed the magnet roll 314, having fixed magnetic poles, in the developing sleeve 313, thereby forming a magnetic brush due to the above described developer D, by this developing sleeve 313 and the magnet roll 314.

On the surface of developing sleeve 313, there will be formed a thin layer of the developer D by the above described magnetic brush. Thickness of this thin layer is made to be thinner than the gap between the developing sleeve 313 and the photoreceptor drum 30, in being formed into an uniform, thin layer of the developer D, for example, by such means as the developer thin layer forming means 317, which is a magnetic cylindrical bar provided against magnetic poles of the magnetic roll 314, pressed against the developing sleeve 313. From the thin layer surface of the developer, the toner T will fly toward the electro-static latent image on the photoreceptor drum due to alternating current bias, thereby developing the electro-static latent image formed on surface of photoreceptor drum 30 into the toner image.

At the time of this developing, there is applied to the developing sleeve 313 a bias voltage, consisting of direct current component and alternating current component, and by controlling this bias voltage with means to be described later, variations in the developing condition between developing devices can be adjusted.

Figure 3:
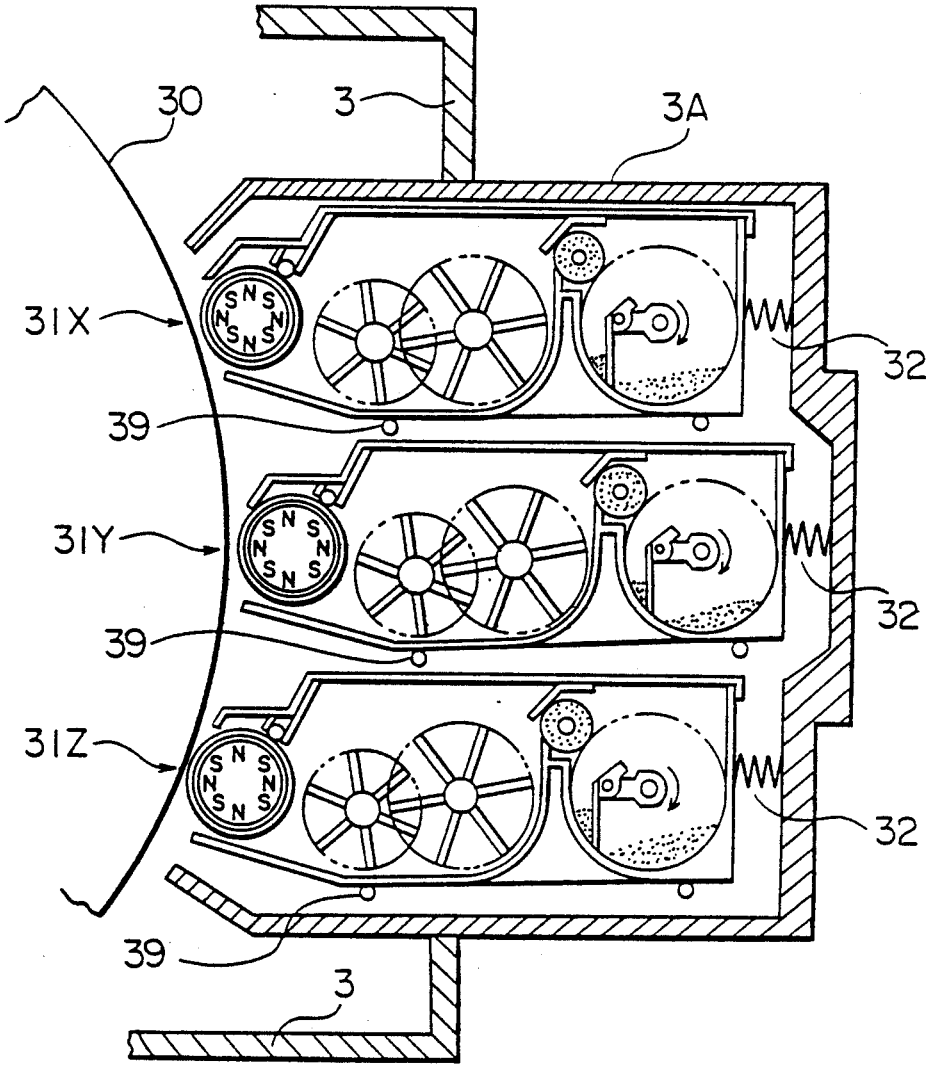
FIG. 3 is a sectional view of the developing unit mounted with developing devices.

FIG. 3 shows a sectional view of the developing unit 3A, in which developing devices 31X, 31Y, 31Z are mounted, and such developing unit 3A constitutes a part of the process cartridge 3. The developing unit 3A is a box, having an opening on the side of photoreceptor drum 30, in which there are provided guide members 39, consisting of rollers, etc. The developing devices 31X, 31Y, 31Z, which are arranged in parallel, are guided by the guide members 39, and are also pressed against the side of photoreceptor drum 30 by the energized elastic members 32, provided in the back of the developing devices, thereby maintaining the established gap between developing sleeve 313 and photoreceptor drum 30.

In the process cartridge 3, there are installed photoreceptor drum 30, developing unit 3A and cleaning device 59, and additionally, the charging device 55 in the present embodiment. Further, when a separating claw is used to assist separation of the transfer material from photoreceptor drum 30, this separating claw is also installed. The motor, which will serve as the driving source of such process cartridge, is provided in the main body 2. It is so arranged that power transmission and electrical connection can be made by coupling, etc., when process cartridge 3 is attached to the main body 2. It is, of course, possible to provide the motor, the driving source, in the process cartridge 3. In this case the process cartridge 3 should have electrical connection made, when it is attached to the main body 2.

The process cartridge 3, which is detachably mounted on and replaced with respect to the apparatus for forming color images, can be classified into the following types (number) and the corresponding toner colors, as one example, depending on the toner colors (combination of developers) stored therein:

310 . . . Yellow (Y), Magenta (M), Cyan (C)
320 . . . Red (R), Blue (B), Green (G)
330 . . . Red (R), Blue (B), Black (BK)
340 . . . Red (R), Black (BK)
350 . . . Black (BK)

The apparatus for forming color images, being mounted with one of those process cartridges, is required to have an image forming process made, corresponding to the process cartridge mounted. Further, it also becomes necessary that the nature of the cartridge (toner color) or the image mode, etc. therefrom be indicated to the users. In the present invention, IC cards are used as means of control related to attachment of those cartridges and also as means of indication thereof, and there are provided IC cards respectively corresponding to all types of cartridges beforehand. That is, for example, IC card CD (310) is made to correspond to the process cartridge 310, and IC card CD (320) to the process cartridge 320.

Figure 5:
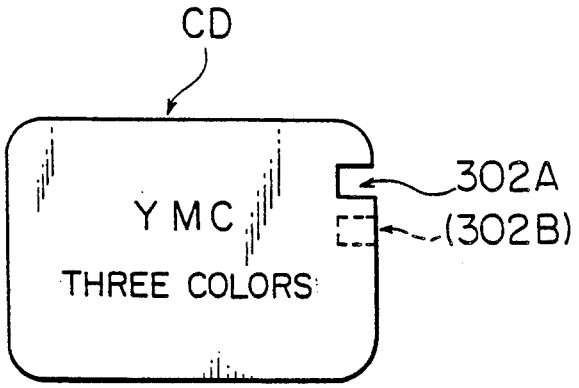
FIG. 5 is a front view of the IC card.

FIG. 4 shows a perspective view of the process cartridge. On the outer wall of the process cartridge there is provided the card mounter 301. IC card CD shown in FIG. 5 has different outer forms (Notch is at 302A position for the one shown in the drawing.) depending on the type, and has an IC having functions described later built therein.

In the card mounter 301 there is the card selecting means 302, having a form of protrusion, etc. This card selecting means 302 will permit only the corresponding IC card, from the positional relationship of the notch 302A in the IC card, to be attached to the process cartridge 3. That is, for example, with respect to the process cartridge 310 only IC card CD (310) can be attached, and IC card CD (320) and IC card CD (330) cannot be attached.

In the IC card, characters and colors are used for indication of its type, and similar indications are made close to the card mounter 301 on the other hand, thereby facilitating the user's application of the corresponding IC card. When the process cartridge 3 mounted with the corresponding IC card is attached to the apparatus for forming color images and the upper box 2A, in open condition, is closed, the cartridge 3 will have electrical and mechanical connections with the main body side. Further, IC card CD will be connected to CPU on the main body side, thereby transmitting information, control program, etc. concerning the process cartridge 3. When the process cartridge 3 is attached to the main apparatus body without mounting IC card, the apparatus for forming color images will take no action at all, and there will be an indication on the operating and indicating board in the main body to tell that the IC card is not mounted.

Figure 6:
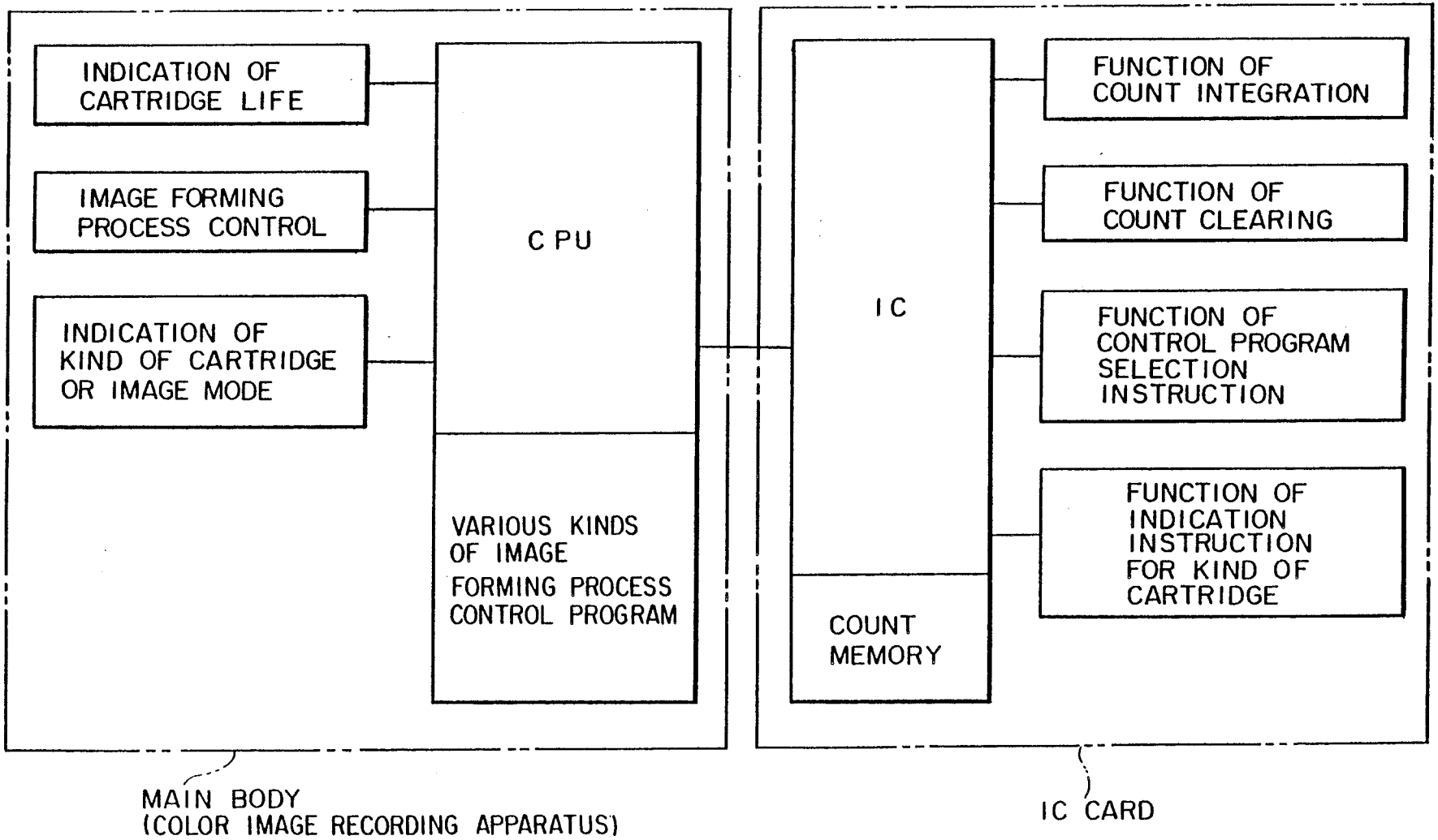
FIG. 6 and FIG. 7 are block diagrams showing connection between CPU of the apparatus body and IC of the IC card and their functions.
Figure 7:
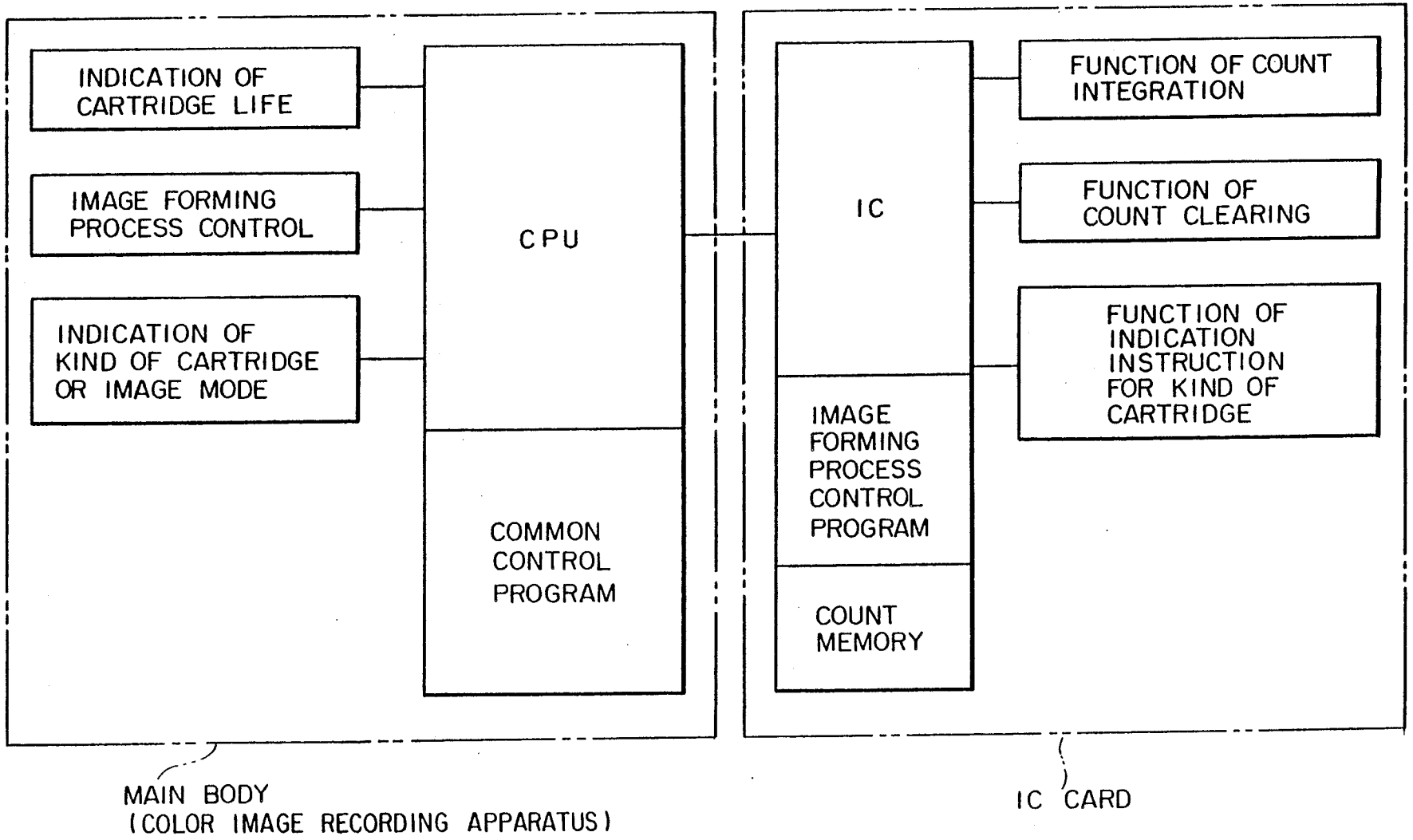

Sharing of control and indicating functions between the IC in the IC card and the CPU on the main body side, in order to perform jointly those functions through the connection to each other, is established and allocated in advance. The embodiment shown in FIG. 6 is a case where the CPU in the main body side stores the control program on various process cartridges, and where the IC in the IC card has functions for selecting and directing the relevant control programs. Against the above, the embodiment shown in Fig. 7 is a case where the CPU in the main body side stores only the common control programs, and where individual, mutually different image forming process control programs are stored in each IC in the IC card side. With respect to other than the above, the two embodiments are in common. One indicates the integrated frequency of image formation in the cartridge, and when the preestablished frequency of image formation has been reached, it urges replacement of the process cartridge by indicating that the cartridge life has been reached.

Further, since the IC card can be used repeatedly, it is of a construction where the previous counted number can be cleared from outside of the IC card, when it is to be mounted on a new process cartridge or newly prepared process cartridge, so as to start new integration of the image forming frequency afresh by clearing the counted number already integrated. As another function, there is available on the IC card side a function of indicating and directing the type of the attached process cartridge, thereby the type of or an image mode performed by the attached process cartridge is indicated on the operating and indicating board on the main body side.

Further, another embodiment will be explained hereinafter. In FIG. 4, it is so arranged to permit users to confirm that the process cartridge 3 and the corresponding IC card are centainly in corresponding relationship. This is not necessarily required with respect to the above mounter 301. Even if the process cartridge 3 is mounted on the recording apparatus body 2, independently by itself, it cannot function at all. Therefore, the IC card CD, which forms a pair with the process cartridge 3, has been made to be attached to the process cartridge 3.

Further, the reason for providing notches 302A, 302B . . . is for permitting automatic distinction of the incorrect correspondence between process cartridge 3 and IC card CD. This arrangement is not necessarily required by all means.

After the user takes out the IC card CD from the card mounter 301 on the process cartridge 3, the user firstly attaches the process cartridge 3 to the apparatus for recording color images, and closes the upper box 2A, which had been in open condition, electrical and mechanical connection between cartridge 3 and the main body side will be made. Next, when IC card CD, taken out from the card mounter 301, is inserted into the slit for the IC card insertion 211 (see FIG. 8), provided on the recording apparatus body 2, the IC card CD is connected to CPU on the main body side, thereby transmitting the information concerning the process cartridge 3 and control program, etc. When process cartridge 3 is attached to the apparatus body, without having the IC card mounted, the apparatus for recording color images will not take any action at all, and there will be an indication on the operating and indicating board of the main body to show that the IC card is not mounted.

Figure 8:
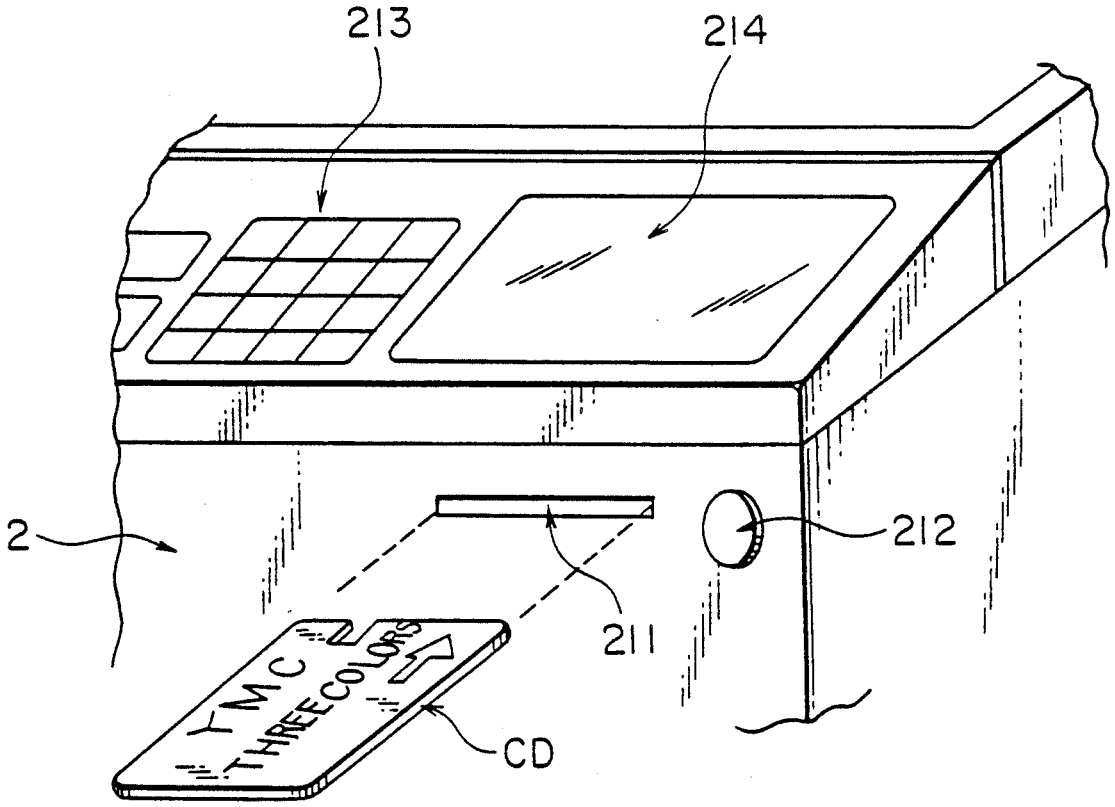
FIG. 8 is an outer view of the essential part on the body side, showing one embodiment of the present invention.

FIG. 8 shows an essential part of the external view of one embodiment for the recording apparatus body 2 of the present invention. Part 211 is the slit for the, card insertion, and Part 212 is the warning lamp. When the IC card CD is not inserted into the IC card insertion slit 211, a warning will be issued by having the red lamp 212 lighted. Part 213 is the message input section, which is provided with copy button, ten-key pad, etc., and part 214 is the message indicator. The message indicator 214 indicates the type of process cartridge mounted, toner color, etc. as well as the number of copies, degree of magnification, etc. by use of LED, liquid crystal, etc.

Sharing of control and indicating functions between IC in the IC card, inserted into IC card insertion 211, and CPU on the main body side, in order to perform jointly the functions through the connection to each other, is established and allocated in advance. These points are the same as those in the preceding embodiment, as shown in FIG. 6 or FIG. 7.

Further, the IC card is also used repeatedly in the present embodiment. Therefore, it is of a construction where the previous counted number can be cleared from outside of the IC, when it is to be mounted on a new process cartridge or newly prepared process cartridge, so as to start new integration of the image forming frequency afresh by clearing the counted number already integrated. As another function, there is available on the IC card side a function of indicating and directing the type of the attached process cartridge, thereby indicating the type of or an image mode performed by the attached process cartridge on the operating and indicating board on the above message indicator 214 on the main body side.

As explained above, various considerations have been made in the present embodiment so that incorrect matching between process cartridge and the corresponding IC card can be eliminated. However, additionally, it is so constructed that the cartridge information can be output to the main body by mounting the process cartridge on the recording apparatus body. It is also possible to construct the apparatus so that by mounting a process cartridge to the recording apparatus body information related to the cartridge is output to CPC, when the output information of the IC card inserted separately into the IC card inserter is in agreement with the information related to the cartridge; the controller in the main body, will continue control of the action as it is, and when the IC card is not in agreement due to some error, an abnormal signal indicating the disagreement is issued to the main body side, thereby having the action stopped.

In the apparatus for recording color images, where various process cartridges are prepared and are replaced as required, and where the process cartridge whose cartridge life has been reached is replaced with a new process cartridge, the following merits, for example, can be obtained by providing the detachable IC card which can be inserted into IC card insertion slit in the apparatus body, and, on the other hand, by attaching the process cartridge to the apparatus for recording color images:

(1) By letting the IC cards have respectively different control functions depending upon the process cartridge, the control program in the CPU on the main body side can be standardized and simplified.

(2) The process cartridge, which is attached surely and correctly, can be identified and controlled. Therefore, the user can make a correct indication for image forming.

(3) The timing for replacement of the process cartridge is displayed on the main body, thereby informing the user.

What is claimed is:

1. A color image forming apparatus comprising:

means for replaceably accommodating a selected one out of a plurality of interchangeable process cartridges each of which includes a unique set of at least one developing device out of a plurality of developing devices, each of said process cartridges having a predetermined operation mode related to the unique set of at least one developing device included therein;

a plurality of card-shaped memory means corresponding, respectively, to the plurality of process cartridges, with each card-shaped memory means being associated with only one of said plurality of process cartridges and storing data representing its predetermined operation mode;

means for relating a card-shaped memory means with the one process cartridge to which the data stored therein corresponds; and control means for receiving the data stored on said card-shaped memory means and, based thereon, performing said specific predetermined operation mode.

2. The color image forming apparatus of claim 1, wherein the relating means comprises a connection member on said process cartridges and having means to receive said card-shaped memory means.

3. The color image forming apparatus of claim 2, wherein the connection member and card-shaped memory means are shaped relative to each other so that only the card-shaped memory means associated with the process cartridge of which the connection member is a part can be operatively accommodated in said receiving means.

4. The color image forming apparatus of claim 3, wherein the connection member includes means for forming an electrical connection between the card-shaped memory means received in said connection member and the control means.

5. The color image forming apparatus of claim 1, wherein the relating means comprises a connection member in a main body of the color image forming apparatus, and having means to receive said card-shaped memory means.

6. The color image forming apparatus of claim 5, wherein the connection member includes means for forming an electrical connection between the card-shaped memory means received in said connection member and the control means.

7. The color image forming apparatus of claim 1, wherein a first one of said plurality of interchangeable process cartridges includes a plurality of said developing devices each usable for a different color, and wherein a second one of said plurality of interchangeable process cartridges includes at least a black color developing device.

8. The color image forming apparatus of claim 7, wherein said control means discriminates said first one of said plurality of interchangeable process cartridges from the second one of said plurality of interchangeable process cartridges on the basis of data stored in said card-shaped memory means.

9. The color image forming apparatus of claim 1, further comprising a display means for displaying the predetermined operation mode on the basis of data stored in said card-shaped memory means.

10. The color image forming apparatus of claim 1, wherein said control means discriminates one of said plurality of interchangeable process cartridges from the others on the basis of data stored in said card-shaped memory means.

* * * * *